US010851966B2

(12) United States Patent
Khosla et al.

(10) Patent No.: US 10,851,966 B2
(45) Date of Patent: Dec. 1, 2020

(54) LED LIGHT SYSTEMS AND DEVICE FOR LOCOMOTIVES AND NARROW BEAM AND MULTI BEAM APPLICATIONS

(71) Applicants: Sanjeev Khosla, New Delhi Delhi (IN); Aarti Khosla, New Delhi Delhi (IN)

(72) Inventors: Sanjeev Khosla, New Delhi Delhi (IN); Aarti Khosla, New Delhi Delhi (IN)

( * ) Notice: Subject to any disclaimer, the term of this patent is extended or adjusted under 35 U.S.C. 154(b) by 189 days.

(21) Appl. No.: 16/065,556

(22) PCT Filed: Dec. 21, 2016

(86) PCT No.: PCT/IB2016/057849
§ 371 (c)(1),
(2) Date: Jun. 22, 2018

(87) PCT Pub. No.: WO2017/109711
PCT Pub. Date: Jun. 29, 2017

(65) Prior Publication Data

US 2020/0149706 A1 May 14, 2020

(30) Foreign Application Priority Data

Dec. 22, 2015 (IN) ..... 4237/DEL/2015

(51) Int. Cl.
*F21V 5/00* (2018.01)
*F21V 29/76* (2015.01)
(Continued)

(52) U.S. Cl.
CPC ..... *F21V 5/008* (2013.01); *B61D 29/00* (2013.01); *F21V 5/007* (2013.01); *F21V 5/048* (2013.01);
(Continued)

(58) Field of Classification Search
None
See application file for complete search history.

(56) References Cited

U.S. PATENT DOCUMENTS 8,931,938 B2 1/2015 Kay
2004/0085779 A1* 5/2004 Pond ..... B60Q 1/04 362/516
(Continued)

FOREIGN PATENT DOCUMENTS

GB 2517332 2/2015
GB 2517332 10/2018
(Continued)

OTHER PUBLICATIONS

International Search Report and Written Opinion; International Patent Application No. PCT/IB2016/057849; dated Apr. 25, 2017 (8 pages).

*Primary Examiner* — Elmito Breval
(74) *Attorney, Agent, or Firm* — Hamre, Schumann, Mueller & Larson, P.C.

(57) ABSTRACT

The present invention relates to an improved LED light system and device for locomotives, stadiums and narrow single or multi beam angle applications wherein LEDs of a cluster are placed on a surface in close proximity in LED lamp unit for generating higher luminous stearance and a lens mechanism provides at least a first external lens and second lens for further collimation preferably bigger determined by the illumination requirements and the space available for the unit/system, mounted in a manner to generate at least one narrow angle beam for reaching a larger and/or lesser distance, the beam being symmetric or asymmetric, the LED Lamp designed for producing greater lamp life, higher efficiency, low maintenance and configurable as Twin, Triple, Quad & more LED Lamp lighting system. The invention improves upon the optical, thermal and electrical designs in terms of efficiency, maintainability, reliability and quality of light using LED clusters for the required area illumination of application for better visibility.

18 Claims, 7 Drawing Sheets

(51) Int. Cl.

| | |
|---|---|
| ***B61D 29/00*** | (2006.01) |
| ***F21V 23/00*** | (2015.01) |
| ***F21V 25/00*** | (2006.01) |
| ***F21V 5/04*** | (2006.01) |
| *F21Y 115/10* | (2016.01) |
| *F21W 131/105* | (2006.01) |

(52) U.S. Cl.
CPC ..... *F21V 23/003* (2013.01); *F21V 25/00* (2013.01); *F21V 29/767* (2015.01); *F21W 2131/105* (2013.01); *F21Y 2115/10* (2016.08)

(56) References Cited

U.S. PATENT DOCUMENTS

| | | | | |
|---|---|---|---|---|
| 2009/0147505 | A1* | 6/2009 | Robinett ..... | H02J 7/35 362/183 |
| 2013/0051045 | A1 | 2/2013 | Kay | |
| 2015/0236221 | A1* | 8/2015 | Deak, Sr. ..... | C08G 18/10 315/185 R |
| 2015/0252973 | A1 | 9/2015 | Muller et al. | |
| 2017/0043702 | A1* | 2/2017 | Park ..... | B60Q 1/085 |
| 2017/0067609 | A1* | 3/2017 | Ichikawa ..... | F21S 41/663 |

FOREIGN PATENT DOCUMENTS

| | | |
|---|---|---|
| IN | 188736 | 7/1998 |
| IN | 188736 | 11/2002 |
| IN | 2063/MUM/2010 | 11/2012 |
| IN | 294/MUMNP/2014 | 1/2015 |
| IN | 313/MUMNP/2014 | 1/2015 |
| JP | 2010234850 | 10/2010 |
| JP | 2013082242 | 5/2013 |
| KR | 101202643 | 11/2012 |
| WO | 2004/031649 | 4/2004 |
| WO | 2009/081382 | 7/2009 |
| WO | 2016/166591 | 10/2016 |

* cited by examiner

Fig. 1d(i)-(a)
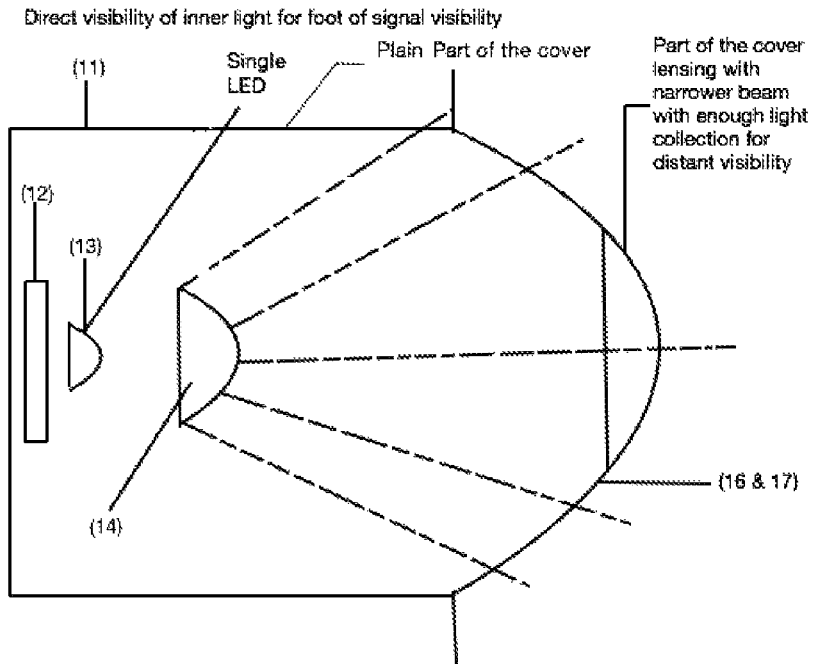
Fig. 1d(i)-(b)
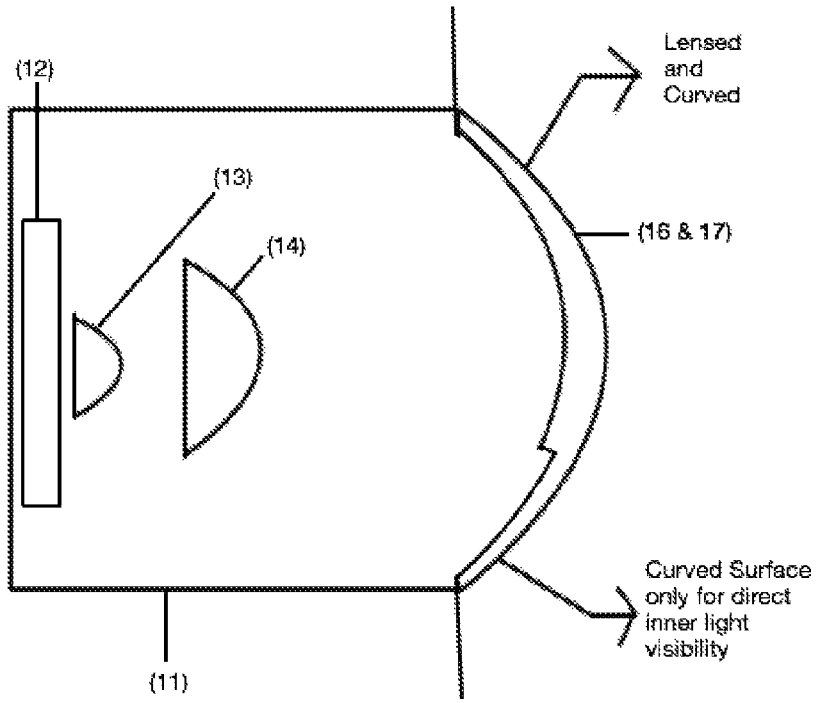

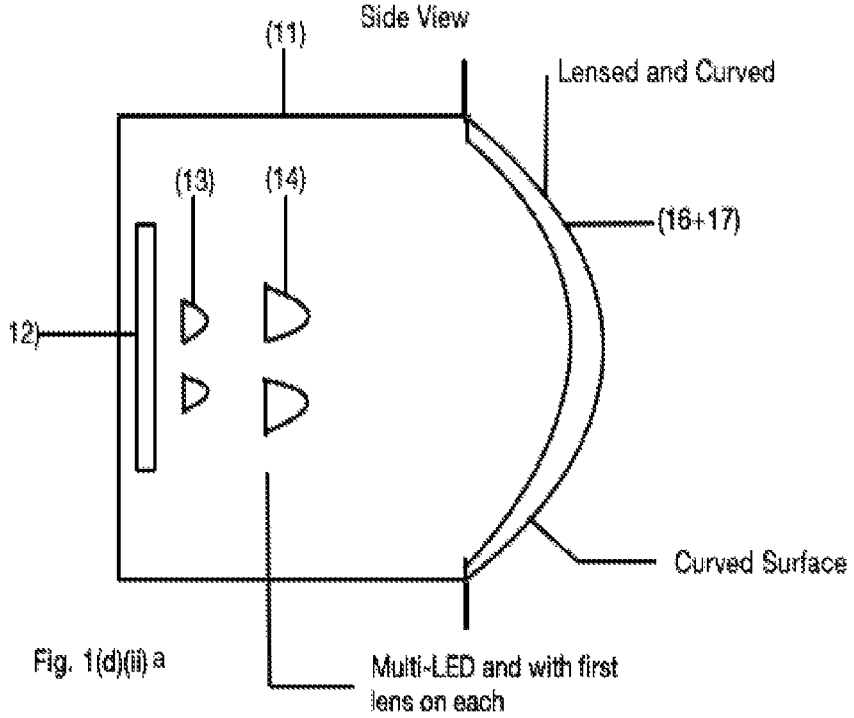
Fig. 1(d)(ii) a
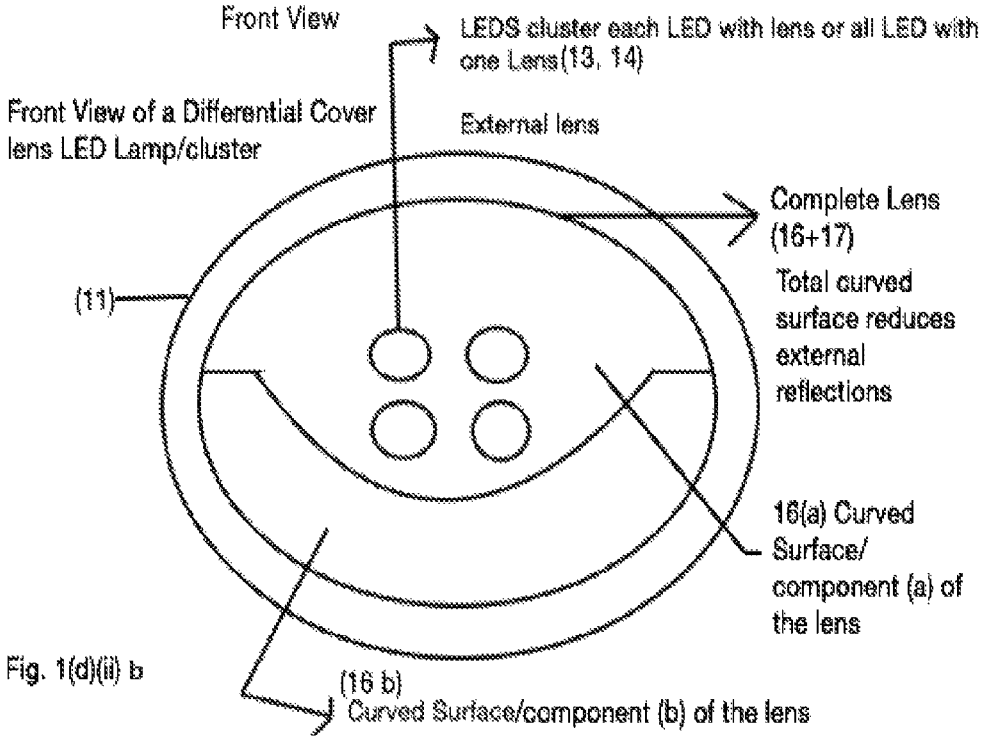
Fig. 1(d)(ii) b

LED LIGHT SYSTEMS AND DEVICE FOR LOCOMOTIVES AND NARROW BEAM AND MULTI BEAM APPLICATIONS

FIELD OF THE INVENTION

The present invention relates to an improved LED light system and device for locomotives, stadiums and narrow single or multi beam angle applications wherein LEDs of a cluster are placed on a surface in close proximity in LED lamp unit for generating higher luminous stearance and a lens mechanism provides at least a first external lens and second lens for further collimation preferably bigger determined by the illumination requirements and the space available for the unit/system, mounted in a manner to generate at least one narrow angle beam for reaching a larger and/or lesser distance, the beam being symmetric or asymmetric, the LED Lamp designed for producing greater lamp life, higher efficiency, low maintenance and configurable as Twin, Triple, Quad & more LED Lamp lighting system. The invention improves upon the optical, thermal and electrical designs in terms of efficiency, maintainability, reliability and quality of light using LED clusters for the required area illumination of application for better visibility.

BACKGROUND AND PRIOR ART

The fundamental addressed by the present invention is to make best use of the LED Technology in the applications being used.

Light sources have two fundamental applications:

a. where they require to be seen, such as signals, warning lights, and such other areas. The fundamental parameter determining their effectiveness is the brightness of the light source. In other words, how well they stand out with respect to their environment, the contrast.

b. where they are required to make the other objects seen.

The present invention is discussed with respect to the application area (b), and is also useful as indicated above both for a and b type, for effective application of LED technology thereby facilitating its benefits and increasing the gains.

The optical needs identified for effective usage for the application are:

i. The intensity of light falling onto the area where the objects are to be seen should be adequate for the human eye to detect them.

ii. The above condition in conjunction with quantum of area and the uniformity of light in that area to be able to decipher easily the large objects at a distance and/or relatively fast moving objects at any distance of the defined region of interest.

iii. For usefulness in applications as indicated in (a) above it relates to a minimum two lens system where effective collimation of the light on the surface of the outer lens to generate primarily collimation into a narrow angle beam as well as provide reasonable surface brightness on the outer lens for nearby by visibility.

The cover of the LED Lamp can itself constitute the second lens. The outer cover is a uniform lens or differentially lensed with its various components for multidirectional visibility. In signalling applications it may constitute a part for nearby visibility which could be differently lensed and/or sufficiently translucent to allow inner lensed light visibility for near signal visibility. The entire outer lens being curved to avoid external light reflection to a maximum extent. In order to minimize the loss of contrast due to external light falling on the signal, the inner background of the light is kept non reflective besides the anti-reflective coating on the outer surface of the outer cover/lens.

It is pertinent to note that for the object to be seen the contrast generated on the object with respect to its environment by the light falling on it, reflected back to and then seen by the viewer has to be adequate for the human eye to detect it with adequate contrast with respect to the surroundings, the uniformity of illumination is also to be adequate so that it is seen in its true perspective.

For example, if a rail vehicle has fallen on the track on which a train is moving towards it at night, if the beam of light falling on the rail vehicle is not able to effectively light up its surface and contours for it to be seen in its right perspective, it will not be detected from that distance even though a man standing near to the rail vehicle is able to see it with the beam of light from the moving train falling on it. If the detection by the train crew is not done within the braking distance, accident is imminent.

Similarly, in a cricket stadium during a match at night, the ball which is hit may not be seen during its entire trajectory even though inside the stadium.

Similarly, the angular surface brightness of the signal facia if not enough and adequately uniform over the display area, may not allow it to be seen in the required shape near the foot of the signal.

Intensity of light is inversely proportional to the square of the distance. Thus, for distant visibility the beam has to be more intense and in train and signals application the distances are large and the requirement of the beam is narrow for far distance. Near distance applications may not be very wide, however, a shaft of beam alongside/on the track is desirable.

The present invention addresses the optical, thermal, electrical and protection domains for the specific use of LED technology, which is a fundamentally different lighting source as compared to the conventional lighting sources, thereby requiring new methods, techniques and variants to reap its maximum benefit.

The existing/prior art some of which is described below do not address comprehensively the fundamental needs of the LED source but tend to juxtapose it into the existing and known methods used with the conventional light sources.

Further, there is also worldwide emphasis for energy conservation. In number of situations in which a light emitting diode (LED) that consumes less power and generates less heat is used in a lighting apparatus instead of an incandescent lamp or a high-pressure discharge lamp and this has been increasing in recent years. Since light emitted from an LED element has a property of high linearity and low diffusion as compared with light emitted from conventional system or devices, LED element is effectively usable as a light source of a headlight equipped in a rail vehicle and other such applications requiring distant, directional, and zonal illumination. For reaching a distance the light has to be intense. However, there are concerns such as increase in dazzlement due to higher luminous efficacy, a failure to illuminate a wide range from a near side to a far region in the travelling direction as only the far region or near side is illuminated. LED is a wide angle power source, but also the light spreads in all directions and in applications which need zonal illumination such as in headlights and narrow beam lights, where collimation of most of its light is a challenge. Conventionally, reflectors are used to do the first level of light collection and then as per need a lens may be used to further collimate the light. However, normal reflectors have substantial absorption, poor light output ratio. In addition, unlike the conventional light sources which perform better when at elevated temperatures, LED performs better when it is protected from heating, i.e., it requires thermal management and heat sinking.

Further, unlike the conventional light sources which are voltage driven, LED is a current driven device.

Also, the conventional light sources can be individually designed for a higher voltage operation to suit the supply conditions, LED is a low voltage and wattage device which requires to be used in series-parallel combination. The purpose of this invention is to provide a suitable complete mechanism for efficient and reliable usage of LEDs in narrow beam and headlight type applications.

It is possible to place a lens in close proximity to the LED to collect its light, however, if substantial collimation is required the lens would have to be (a) very thick thereby causing higher losses and (b) minor error in placement can cause substantial change in the beam light collimation. Further, the beam generated would be corresponding to the size of the LED chip and hence very narrow and pointed, whereas, it is desirable to produce a uniform wider beam to be collimated well enough to substantially uniformly illuminate the distance far ahead along the optical axis of the LED Lamp formed using LED cluster.

Further, it is desirable to have a DIP/DIM light function in addition to main head light beam. In conventional sources, this was generated by using a second filament of the bulb having a different wattage and mostly a different physical position with respect to the focal point of the main reflector and also a second reflector to further direct the beam away from the main beam axis.

Some of the LED headlight devices that relate to motor vehicles are indicated in Indian application numbers 2063/MUM/2010, 294/MUMNP/2014, 313/MUMNP/2014. Also, EP 14002159.3 relates to a LED vehicle headlight wherein each light unit has a LED board with a luminous surface and an optical device associated with a reflector and/or a lens. A reflector holder carries the optical devices of the light units and is formed in one piece with the latter. A board holder is fastened detachably to the reflector holder. The board holder has a receptacle for each light unit, and the LED board has contact surfaces that come into contact with corresponding contact surfaces on the reflector holder to position the LED board with respect to the assigned optical device when the board holder is fixed on the reflector holder. Each light unit has elastic pressurising means that act on the LED board in order to press its contact surfaces against the contact surfaces of the reflector holder when the board holder is fixed on the reflector holder.

Some of the LED headlight devices specifically related to rail vehicle or locomotives are disclosed herein below:

Document GB2517332 provides a rail vehicle equipped with an LED headlight that is for illuminating a wide area stretching from near the travel direction of the rail vehicle to a far distance, that has a light reducing function for changing the light axis in order to control blinding and for reducing the overall light volume, and that has reliability such that, when any light source malfunctions, another light source can be used as a replacement for the malfunctioning light source, and operability such that an operation for reducing blinding after any of the light sources malfunctions does not become complicated. With respect to a railway vehicle equipped with an LED headlight comprising a plurality of far distance light sources for illuminating a far distance, a plurality of near distance light sources for illuminating a near distance, and a power source for providing power to the far distance light sources and the near distance light sources, the present invention is realized by a rail vehicle equipped with an LED headlight characterized by having one light source comprising the far distance light source and the near distance light source, and another light source comprising only the near distance light source, and in that the one light source and the other light source can be selectively lit.

This prior art document focuses on the mechanical arrangement of LED modules for generating distant and far beams. This is already known in the art in the concept of stadium lighting where multiple spot lights are mounted on a matrix platform and angle of the lights is individually adjusted to suit the near and distant areas of lighting. Further, its main objective is to reduce the effect of dazzlement, for which switching over power from far distance illuminating LED cluster is changed to near distance lighting LED cluster. The use of LED cluster for lighting is known in the art and switching from main beam to dip beam is known in the headlight industry and application including locomotives for ages. This document also discloses that in the event a LED module fails, by detecting its current a mechanism can switch over to another light. But LED is a current driven device and even under constant current conditions its illumination reduces, though over a period of time. This shows lack of knowledge about LEDs as LED is a semiconductor device and can fail as short or open and also a current driven device having a very long life unlike the earlier lighting source being the filament bulb being voltage driven device which could only fail as open and have a relatively much shorter life. Further, the LED being a long life device when driven as per its requirements and not like a bulb it has a longer life than the current detector (electronics) used to detect its current failure. The disclosure in this prior art document suffers on the account that it speaks of connecting a power source to LED cluster, does not speak of how as it being a current driven device, its current can increase exponentially with minor increase in voltage. Further, unlike the other light sources which work well on higher temperatures, LED needs protection from heat and temperature rise as being a semiconductor and itself a heat generating device, there is no mention of thermal management. The power sources on locomotives have voltage variations and surges generated through their electrical system. Therefore, the product conceived through this prior art document suffers on protection on all these accounts.

Use of LEDs which are more expensive than the conventional light sources, becomes viable in terms of improvement in efficiency i.e. gains from energy saving, the requisite usage to enhance their useful life thereby also reducing maintenance costs giving significant advantage in cost savings & operation with better illumination at lower energy.

Therefore, this prior art document relates to a wiring and switching system of multiple LED clusters placed at different angles in LED head light for dip function from far distance beam to near distant beam to prevent dazzlement, does not cover thermal management, electrical and optical management for efficiency, reliability, protection, controlled drive to LEDs and quantum of improvement over the conventional headlight system. It merely shows a string of LEDs connected to a power source as in FIG. 4. Other figures are pictorial presentation of mechanical body of the headlight frame/housing.

JP2013082242—provides a railway headlight in which an LED light is used while retaining a sufficient illumination level. The headlight in this embodiment includes: a high beam light (13*a*) disposed on a high beam base (12*a*); a low beam light (13*b*) disposed on a low beam base (12*b*); a high beam lens (15*a*) which is disposed in parallel with a side surface of the high beam base (12*b*) and to which the high beam light (13*a*) is mounted in a travelling direction via a mounting frame or a high beam barrel (14*a*); and a low beam lens (15*b*) which is disposed at a different angle from the high beam lens (15*a*) and to which the low beam light (13*b*) is mounted in the travelling direction via the mounting frame or a low beam barrel (14*b*).

US20130051045 provides a locomotive LED/optics headlight assembly—A headlamp assembly comprising a housing forming an internal chamber and forming an opening to one side, at least a first light source having a first illumination axis, the first light source mounted in a central portion of the internal chamber substantially at a first depth, at least a second light source having a second illumination axis, the second light source mounted in a circumferential portion of the chamber substantially at a second depth wherein the first depth is greater than the second depth, a first aspherical lens formed about a first optic axis, the first aspherical lens mounted within the opening with the first optic axis aligned with the first illumination axis and a second aspherical lens formed about a second optic axis, the second aspherical lens mounted within the opening with the second optic axis aligned with the second illumination axis. The invention relates to head light using LED and Lens which suffers on following accounts—(a) The LED is a wide angle device. In this invention, placing the LED in a chamber with certain depth causes substantial absorption (loss) of the emitted LED light. The lens placed at a suitable height to collimate the Light captures only a small fraction of the LED light. Thus, the overall efficiency of the system comes down substantially. The LED Luminous efficacy would be typically >130 lumens per watt whereas the system luminous efficacy would be substantially lower as also indicated in the datasheet of the product produced according to the invention is only about 40 lumens per watt.

The above invention also suffers from the fact that it requires fixed chambers in an enclosure. The enclosure has standard external dimensions which say can be as per PAR56. Thus, as the chambers are integral part of the die cast material, their reflectivity is also poor and flexibility is also limited.

U.S. Pat. No. 8,931,938 [corresponding to U.S. application No. 61/528,545]—provides a headlamp assembly comprising a housing forming an internal chamber and forming an opening to one side, at least a first light source having a first illumination axis, the first light source mounted in a central portion of the internal chamber substantially at a first depth, at least a second light source having a second illumination axis, the second light source mounted in a circumferential portion of the chamber substantially at a second depth wherein the first depth is greater than the second depth, a first aspherical lens formed about a first optic axis, the first aspherical lens mounted within the opening with the first optic axis aligned with the first illumination axis and a second aspherical lens formed about a second optic axis, the second aspherical lens mounted within the opening with the second optic axis aligned with the second illumination axis.

In KR101202643 a headlight for an electric train is provided to improve the durability of the headlamp by installing a window in front of a lens module to block wind and rainwater. A heat sink (10) fixes a plurality of heat sinks (41). An LED board (D) is located in front of the heat sink. A lens module (K) is composed of a lens housing (20) and a lens (30). A window is fixed to the front of the lens module and blocks wind and rainwater. A converter (50) discharges heat by forming an additional heat radiation fin (51) outside.

JP2010234850 teaches the headlight device (20) for the rail car include headlight (25), a present position acquisition section (21), a storage section (23), a determination section (24), and a control section (26). The headlight (25) illuminates the front side in the advancing direction of the car (1). The present position acquisition section (21) acquires the present position of the car (1). The storage section (23) stores linear information (23*a*) including positions of straight-line sections, positions of curved-line sections, and the shape information of the curved-line sections with regard to a railway on which the car (1) travels. The determination section (24) determines whether or not the car (1) is positioned at a switching section before entering the curved-line sections based on the present position and the linear information (23*a*). The control section (26) identifies the shape information of a curved-line section that the car (1) is about to enter based on the present information and the linear information (23*a*) and controls the illumination direction of the headlights 25 based on the identified shape information.

Indian Patent No. 188736 also relate to twin beam headlight for locomotive upgrading railways from single bulb steam era headlight to twin beam halogen headlight which was reliable and effective.

However the products as indicated in the Indian documents cited above had the following drawbacks:

- bulb life was limited to few hundred hours,
- degradation of reflectors led to reduction in illumination
- degradation of the filament led to reduction in illumination within the short life span of the filament bulbs
- Redundancy of light units in the product was limited to the no. of beam lamps used, as the focussing of the bulb to provide beam of light usable at few hundred meters required sufficiently large size reflectors, or a combination of large size reflectors & lenses, not many such sub-units could be used, in the limited space available. In a locomotive for example using twin beam headlight if both beams of headlight have failed while in service, it is declared dead and has to be withdrawn from service, and replacement locomotive has to be sent on site to meet the safety requirements. This is very expensive.
- The convertors used to make the driving voltage, for example of commercially available 24V halogen bulbs to 110 or 72V of Locomotive can also fail due to aging or high electrical surge at its input, leading to Headlight failure.

Headlights are frequently provided with spare bulbs to meet with the contingency of failure while in service. However if the convertor has failed giving higher output voltage leading to bulb failure, replacement bulb would also meet the same fate.

Halogen filament bulbs though more efficient than the ordinary filament bulbs are still very inefficient. By virtue of their optical pattern requiring use of reflectors, there is further degradation in efficiency.

The conventional system for locomotives suffers from following drawbacks:

a) Open reflector, though protected by front glass is prone to ingress of dust and degradation of reflectivity.
b) Incandescent filament bulbs used are mounted on an assy requiring adjustment of focus which is labour intensive. Further, this requires an opening on the rear of the reflector which may not be fully sealed leading to ingress of dust etc. degrading the reflector over a period of time.

c) Lamp failure in headlight leads to affecting locomotive working while in use, having a direct bearing on earnings.

d) Locomotives are provided with headlight in both the direction as they may be required to move in either direction. For this purpose the voltage stepping down device may be common for both the headlights and separate depending upon the locational and wiring advantage. Failure of device used to step down i.e. transformer, resistor or DC to DC convertor, leads to switching OFF of the headlight, effecting locomotive working, which has direct bearing on earnings.

e) Provision of standby stepping down devices leads to additional cost, space and wiring requirements.

f) Bulbs used are of coil filament of lower luminous efficacy. These are prone to failure on vibration.

g) AC transformer or drop resistors when used as stepping down devices provide unregulated voltage to the bulb. During voltage fluctuating conditions higher voltage is fed to the headlight lamp leading to bulb failure.

h) DC to DC convertor though gives regulated output but does not have over voltage tripping at the input end leading to un-regulation or failure under higher input supply conditions to the convertor, which in turn leads to system or lamp failure.

i) Drop resistors suffer from heat dissipation and stepping down transformers from enormous size.

j) During working of locomotive it is required to dim/dip the light to avoid glare into eyes of driver of locomotive approaching from opposite direction, which is presently achieved by lowering the applied voltage to the single filament lamp. This, however, makes light ineffective due to lowering of colour temperature.

k) Front glass of headlight is protected by a steel guard to save from breakage leading to failure in case of bird hit or such other incidents. This, however, partially obstructs the light coming out and prevents easy cleaning of the headlight glass, besides adding to weight.

Accordingly, the inventors of the present invention to overcome the above drawbacks have invented a LED multi beam light system giving more reliability and redundancy for railway system that saves more energy have more lamp life and also provide better spectrum of light. The invention provides a means to use LED as a lighting source, collect most of the LED light efficiently for the required zonal, and collimate it effectively for the application, provide an efficient DIP/DIM facility, where required. The device may also be used in other applications such as stadium lights and also for other defined boundary, directional lighting applications for which beam/s of light with angular control optics, symmetrical and/or asymmetrical, and also for applications that use reflectors and conventional light sources and additionally lenses to configure and direct the optical pattern for the required illumination pattern.

The drawbacks and the need for improvements have been discussed with respect to a locomotive headlight application. Similar needs apply to various other narrow beam, multi-beam applications like stadium lighting, border lighting, signals, which would benefit from this invention

SUMMARY OF THE INVENTION

One of the main embodiment of the present invention comprises a LED light system for locomotives and alike narrow beam, multi-beam angle applications comprising:

a LED Lamp having at least one LED cluster (4), mounted on a thermally conductive enclosure with substantially transparent cover, at least one conventional LED inclusive of its in-built optics in the LED Lamp having at least one external lens (14), at least one LED having a twin external lens (16) to further collimate the light for narrow angle beam for distant illumination, spatial distribution control and a power source (1) connected to said LED Lamp through an output unit (2)

wherein, the output unit (2) comprises at least one under and over control means (UOM)(6) and at least one sensing means (8) and a multi-feedback means (MFM) (7) connected to said under and over control means (6) operating on the feedback from said at least one sensing means (8), the state of the under and over control means depending upon the input received from said at least one sensing means (8) and the LED's and/or optics of a cluster are placed on a surface in close proximity for generating higher luminous stearance and the said LEDs of the cluster have a thermal control means attached to each LED and the said thermal control means is formed by a thermally conductive enclosure wherein the lens in the twin lens placed close to the LED Light source is such that it acts as a light collector for most of the exited light from the conventional LED cum collimator which acts as a virtual low loss reflector and collimates most of the light onto the second lens mounted such that the desired directional beam is generated.

Yet another embodiment of the present invention comprises of a LED light system for locomotives and alike narrow beam, multi-beam angle applications wherein at least one LED, the said LED having at least one LED chip or multichip LED being a chip on board.

Still another embodiment of the present invention comprises of a LED light system for locomotives and alike narrow beam, multi-beam angle applications wherein the transparent cover itself is the second lens.

Still yet another embodiment of the present invention comprises of a LED light system for locomotives and alike narrow beam, multi-beam angle applications wherein, the twin lens comprises intervening space formed into an enclosure to increase the optical efficiency of the beam intensity by further directing the light not falling on to the lens due to any reason including Fresnel effect, the said enclosure having a suitable reflecting surface.

Yet another embodiment of the present invention comprises of a LED light system for locomotives and alike narrow beam, multi-beam angle applications wherein the twin lens is optionally mounted to generate the desired narrow angle beam through its dual mechanism by varying the mounting position of the dual mechanism with respect to LED, individually or either independently or jointly to generate an efficient collimated beam.

Yet another embodiment of the present invention comprises of a LED light system for locomotives and alike narrow beam, multi-beam angle applications wherein, the beam angle of the LED source and the size of the first lens are optionally selected, to have all the LED light fall on the first lens surface.

Still yet another embodiment of the present invention comprises of a LED light system for locomotives and alike narrow beam, multi-beam angle applications wherein, optionally the inner lens is smaller and outer lens is bigger so that the outer lens can have reduced thickness, higher focal length and yet to collect the entire light exiting the first lens.

Yet another embodiment of the present invention comprises of a LED light system for locomotives and alike narrow beam, multi-beam angle applications wherein, the collimation of the light is optionally asymmetrical, i.e. narrower on one axis and wider on the other axis to give longitudinal or horizontal or wider illumination along any required axis.

Still another embodiment of the present invention comprises of a LED light system for locomotives and alike narrow beam, multi-beam angle applications wherein, the asymmetrical pattern is optionally achieved through a single external lens.

Another embodiment of the present invention comprises of a LED light system for locomotives and alike narrow beam, multi-beam angle applications wherein, the asymmetrical pattern is optionally achieved through a twin external lens.

Still another embodiment of the present invention comprises of a LED light system for locomotives and alike narrow beam, multi-beam angle applications wherein, the lens and LED assemblies are optionally placed in close proximity to form a combined mono axis or multi axis beam, symmetrical and/or asymmetrical.

Yet another embodiment of the present invention comprises of a LED light system for locomotives and alike narrow beam, multi-beam angle applications wherein, the single external lens is mounted with its optical axis with respect to the optical axis of the LED at an angle for one or more LED's in the LED cluster (4) of the lamp, to tilt its beam with respect to the optical axis of the LED lamp.

Still yet another embodiment of the present invention comprises of a LED light system for locomotives and alike narrow beam, multi-beam angle applications wherein, the said output unit (2) is optionally integrated within the lamp unit.

Yet another embodiment of the present invention comprises of a LED light system for locomotives and alike narrow beam, multi-beam angle applications wherein, at least one surge protection device (SPD) (5) is optionally integrated or separate with the output unit (2). Still yet another embodiment of the present invention comprises of a LED light system for locomotives and alike narrow beam, multi-beam angle applications wherein, the said surge protection device (5) is optionally a spare unit separate or integrated as a switchable standby SPD unit.

Yet another embodiment of the present invention comprises of a LED light system for locomotives and alike narrow beam, multi-beam angle applications wherein, the surge protection device (SPD) (5) shall be optionally provided with at least one spike arrestor/MOV and a fuse.

Still another embodiment of the present invention comprises of a LED light system for locomotives and alike narrow beam, multi-beam angle applications wherein, SPD (5) shall be optionally provided with spike arrestor/MOV and a Gas Discharge tube, in which case fuse may or may not be provided.

Further yet another embodiment of the present invention comprises of a LED light system for locomotives and alike narrow beam, multi-beam angle applications wherein, the SPD is optionally self-restoring wherein it shall cut off when the surge/overvoltage is greater than duration T1.

Yet still another embodiment of the present invention comprises of a LED light system for locomotives and alike narrow beam, multi-beam angle applications wherein, the said SPD is optionally self-restoring with cut off lower than the operating voltage of the MOV in the SPD wherein spike arrestor/MOV shall absorb the surges up to duration (T1).

Another embodiment of the present invention comprises of a LED light system for locomotives and alike narrow beam, multi-beam angle applications wherein, when external surge protection device [ESPD] is provided, the output unit (2) may be optionally provided with internal spike control/MOV which then is of higher voltage than that in SPD so that MOV in the SPD would fail being operative at a lower voltage in the event cut off is not provided or provided and does not operate protecting the MOV in the output unit (2) and thereby the output unit (2), LED Light would be prevented from replacement & SPD placed at a convenient location can be easily replaced thereby reducing the cost of spares and maintenance.

Still another embodiment of the present invention comprises of a LED light system for locomotives and alike narrow beam, multi-beam angle applications wherein, when the combination of SPD & MOV is inside the output unit (2), MOV of the output unit (2) shall optionally have the higher operating voltage than the MOV inside the SPD followed by the self-restoring cut-off which shall be lowest in operating voltage and as long as the cut-off operates the entire system operation shall be self-restoring when voltage surge diminishes and operating voltage is within the specified limits of normal operation.

Yet another embodiment of the present invention comprises of a LED light system for locomotives and alike narrow beam, multi-beam angle applications wherein, the high voltage and/or low voltage cut off is provided.

Still yet another embodiment of the present invention comprises of a LED light system for locomotives and alike narrow beam, multi-beam angle applications wherein, if the high voltage cut off is the lowest operating voltage then optionally the high voltage cut-off may not be provided in the SPD.

Yet still another embodiment of the present invention comprises of a LED light system for locomotives and alike narrow beam, multi-beam angle applications wherein, at least one output unit (2) is optionally a spare unit.

Yet another embodiment of the present invention comprises of a LED light system for locomotives and alike narrow beam, multi-beam angle applications wherein, the said LED lamp has at least one LED having a twin lens to direct the light.

Still another embodiment of the present invention comprises of a LED light system for locomotives and alike narrow beam, multi-beam angle applications wherein, dimming facility is provided optionally for reducing the average current flowing through LEDs with power saving.

Yet another embodiment of the present invention comprises of a LED light system for locomotives and alike narrow beam, multi-beam angle applications wherein, a switch control is optionally provided to produce a dip and/or dim means for reducing and/or changing the direction of the light or leaving lit only the changed beam direction of LED light sources. Still yet another embodiment of the present invention comprises of a LED light system for locomotives and alike narrow beam, multi-beam angle applications wherein, a means is optionally provided for shifting the illumination axis of the light by changing the mounting angle of the lens with respect to the LED i.e. the mounting axis of the lens with respect to the mounting axis of the LED or the mounting axis of the LED itself along with its lens by changing the mounting axis of the surface for the LED in the enclosure.

Still yet another embodiment of the present invention comprises of a LED light system for locomotives and alike narrow beam, multi-beam angle applications wherein, a means is optionally provided to produce a dip and/or dim means by having the shifted illumination axis LEDs lit and others on the main illumination axis unlit.

Yet another embodiment of the present invention comprises of a LED light system for locomotives and alike narrow beam, multi-beam angle applications wherein, an external control interface is provided to activate the DIP/DIM or main or combined beams.

Still yet another embodiment of the present invention comprises of a LED light system for locomotives and alike narrow beam, multi-beam angle applications wherein, each beam is optionally defined as the beam formed by using at least one LED or a cluster of LEDs wherein even with cluster of LEDs each LED lamp unit may have multi-directional beams. Yet another embodiment of the present invention comprises of a LED light system for locomotives and alike narrow beam, multi-beam angle applications wherein the LED light system, wherein the dimming facility optionally uses the external SPD that may be installed before the dimming selection switch where the Dimming line & the Main (full light) line are separated but carry the same power supply.

Yet another embodiment of the present invention comprises of a LED light system for locomotives and alike narrow beam, multi-beam angle applications wherein, the light/lamp is optionally sealed with at least one cover preferably glass to prevent ingress of water and dust, wherein the transparent cover of the LED Lamp is optionally formed using a toughened glass.

Yet another embodiment of the present invention comprises of a LED light system for locomotives and alike narrow beam, multi-beam angle applications wherein, the said beam lamp or lamps are optionally replaceable.

Another embodiment of the present invention comprises of a LED light system for locomotives and alike narrow beam, multi-beam angle applications wherein, the lamps cover is optionally kept small enough to have adequate impact strength and comprises optionally adequate cut-outs in a metal mounting frame to allow full light emission to avoid the need of bird guards.

Yet another embodiment of the present invention comprises of a LED light system for locomotives and alike narrow beam, multi-beam angle applications wherein, optionally one adjustment means is provided for making the beam lights exiting the LED Lamps in a multi-lamp system in the same direction coherent, or adjustment in any direction with respect to each other.

Yet another embodiment of the present invention comprises of a LED light system for locomotives and alike narrow beam, multi-beam angle applications wherein, optionally second adjustment means is provided for directing the said multi-lamp beam light with respect to the locomotive/mounting plane.

Yet another embodiment of the present invention comprises of a LED light system for locomotives and alike narrow beam, multi-beam angle applications wherein, each beam is optionally defined as the beam formed by using at least one LED lamp unit and multi-beam is formed by more than one such LED Lamp unit.

Still yet another embodiment of the present invention comprises of a LED light system for locomotives and alike narrow beam, multi-beam angle applications wherein, the output unit (2) facilitates energy efficient conversion, through a driver circuit allowing the Power source (1) and its variations to be matched to the controlled drive required for the LEDs with input and/or output control using under over control means, as per the requirement of different voltage and/or current of the series and parallel combination of the LED array cluster.

Yet still another embodiment of the present invention comprises of a LED light system for locomotives and alike narrow beam, multi-beam angle applications wherein, the sensing means (8) is selected from a current sensing means, voltage sensing means, temperature sensing means, optical sensing means or any combination thereof.

Further yet another embodiment of the present invention comprises of a LED light system for locomotives and alike narrow beam, multi-beam angle applications wherein, the thermally conductive enclosure is provided with heat sink fins for faster extraction of heat, since due to space limitations the thermally conductive enclosure surface becomes inadequate for thermal management.

Yet another embodiment of the present invention comprises of a LED light system for locomotives and alike narrow beam, multi-beam angle applications wherein, the said LED's of a cluster are optionally placed on a substantially flat single or multisided surface.

Still another embodiment of the present invention comprises of a LED light system for locomotives and alike narrow beam, multi-beam angle applications wherein, the twin lens comprises of an enclosure having an external as well as internal reflecting surface.

Yet still another embodiment of the present invention comprises of a LED light system for locomotives and alike narrow beam, multi-beam angle applications wherein, the said system optionally has an active or a passive shunt across a series of said LED cluster (4) to reduce the current flow through LED's to reduce the illumination/dimming of light.

Yet another embodiment of the present invention comprises of a LED light system for locomotives and alike narrow beam, multi-beam angle applications wherein, active or passive shunt is optionally provided across each LED in series in the LED cluster (4) to prevent failure in the event of open circuit failure of the LED.

Further, yet another embodiment of the present invention comprises of a LED light system for locomotives and alike narrow beam, multi-beam angle applications wherein, the said LEDs are optionally provided in the LED cluster (4) Still yet another embodiment of the present invention comprises of a LED light system for locomotives and alike narrow beam, multi-beam angle applications wherein, the said LED light device is as headlights for locomotives, stadium and other narrow beam applications.

BRIEF DESCRIPTION OF THE DRAWINGS

The invention is further illustrated by way of following figures which should not be construed to limit the scope of the invention.

DETAILED DESCRIPTION OF INVENTION

The present invention provides a LED Multi Beam Light System giving more reliability, redundancy for locomotives such as railways and other narrow beam applications such as signals, stadium light and alike comprising the following advantages by way of an example for Twin beam Halogen Light used for locomotives on Indian Railways:

1. Power Saving of greater than 65% (approximately 6.5 Billion Watt Hours per annum on Indian Railways.
2. Return on investment of approximately 3 years (since power used on locomotive is very expensive considering all the transmission & conversion losses)
3. Meets & improves upon the current Indian Railway Specification for Locomotive Headlights.
4. Illumination improvement more than 20% with LED multi-beam twin Head Lamp Unit
5. Much superior spectrum for Night visibility (White Light)
6. Most superior light source for human eye
7. Configurable as Twin, Triple, Quad Head Lamp Unit and required variation in illumination pattern.
8. More Useful for Resolution of objects on track and visibility on curves/turns.
9. Works directly on 110V DC/72V DC.
10. No separate DC-DC Converter Unit required
11. Lamp life of greater than 25000 hours.
12. No periodic lamp changing required;
13. Maintenance free and
14. No focusing required.

Figure 1:
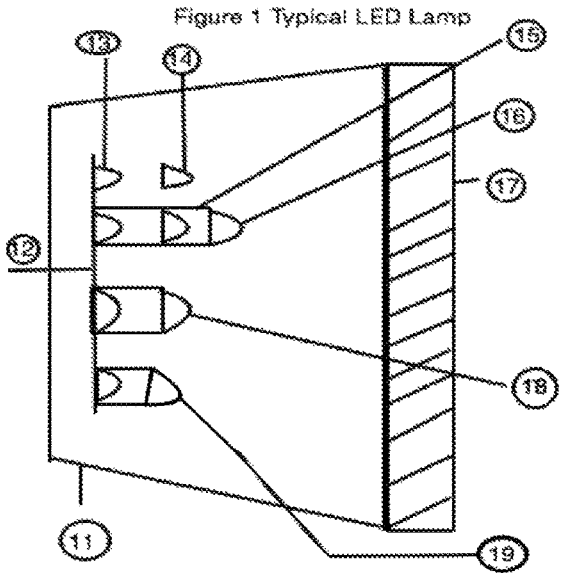
FIGS. 1(*a*), 1(*b*), 1(*c*), 1*d*(i)-(a) and (b), 1*d*(ii)-(a) and (b) show by way of an example some of the typical constituents of the LED Lamp.
Figure 1:
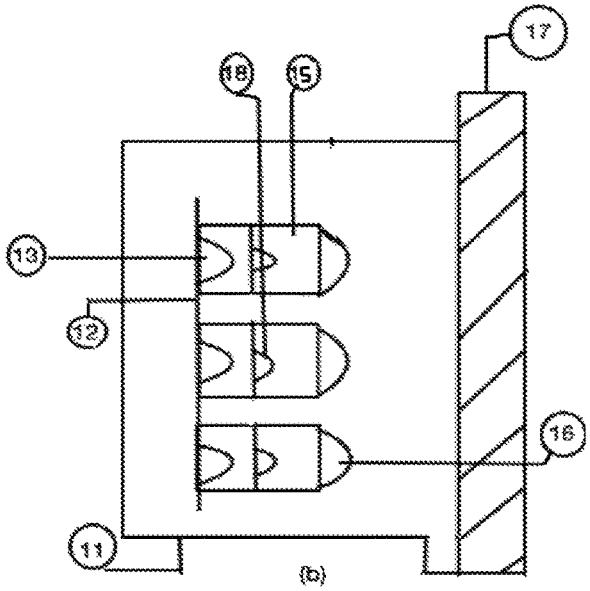
Figure 1:
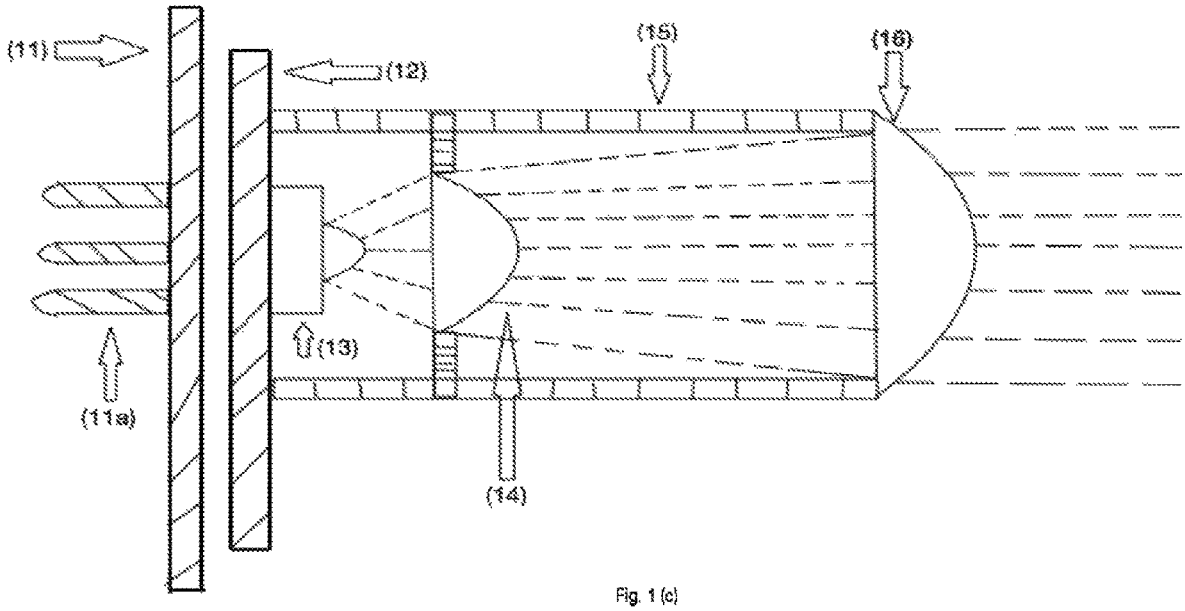

The present invention is illustrated by way of figures, wherein in FIGS. 1 *a, b, c*, feature (11) shows the lamp enclosure which is thermally conductive acts as a heat sink as well and which may optionally have heat sink fins as shown in 11(*a*) as per the design requirements; feature (12) shows the PCB mounting the LEDs which preferably is MCPCB and mounted on the enclosure with thermally conductive medium; feature (3) shows the LED chip with its own optics, feature (14) shows first external lens preferably designed and placed in a manner to collect most of the light emitted by the conventional, power, single chip, multi-chip LED (13) and collimates it; and feature (15) shows the enclosure covering the space between the first external lens and the second external lens comprising a part of the twin lens assembly. The internal surface of the enclosure, being adequately reflective to redirect the stray light in the assembly generated due to Fresnel affect, or any reason causing reflection of the light from the lenses in the assembly, any lack of collection by the first lens or any other reason. The external surface of the enclosure may also be adequately reflective to reflect out the light not exiting the Lamp as may be caused due to the external lens (16) function shown in FIG. 1 (*a*), the single lens being placed close to the conventional LED with its optical axis coinciding with the LED optical axis or tilted as shown in feature (19) to achieve the desired function, placed in their respective positions with suitable mounting arrangement. Feature (17) shows the External transparent or Translucent cover.

FIGS. 1*d*(i)-(a)&(b) show a single LED Assembly (13) which may be at least one chip based where the front cover is the also the external/second lens with differential lensing, and curved surface to minimise the reflection external light to the viewer and reduce phantom affect. FIG. 1*d*(i)-(a) shows higher power lensing in the centre, FIG. 1*d*(i)-(b) shows differential lensing online part of the lower half of the lens.

FIG. 1*d*(ii)-(a)&(b) also show similar lensing combination with more than one LED in the LED Lamp.

Figure 2:
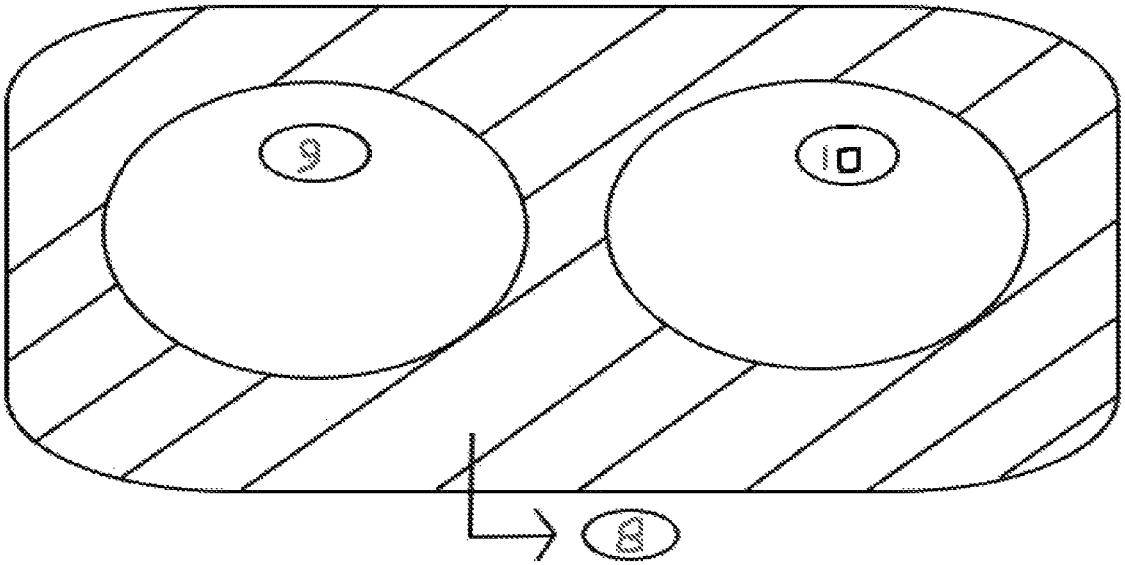
FIG. 2 shows a metal Lamp Mounting Frame (8) having cut outs (9) and (10) for mounting of lamp units.

In FIG. 2, the cut outs (9) and (10) allow the light exiting from the glass/transparent cover of the LED lamps to go through and the rest of the area being metal, the need for bird guard, when mounted on a vehicle, locomotive is avoided, thus, there is no obstruction to the light exiting the lamp units.

Figure 3A:
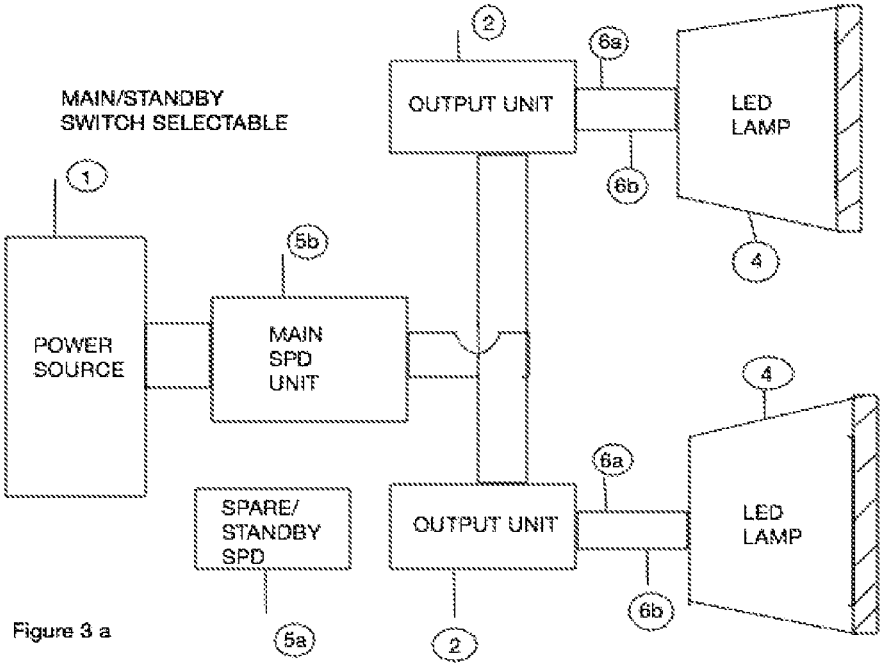
FIGS. 3 (*a*) and 3(*b*) show typical wiring diagrams of SPD (Surge protection Device), output unit, cable & selector switch for a locomotive application using twin LED lamps.

FIGS. 3(*a*) and 3(*b*) show a typical wiring diagram of SPD (Surge protection Device) 5(*b*)(Main) & 5(*b*) Spare SPD unit which would be wired through a manual or automatic switch selection to become available as a Standby optionally with Indicator, in the event the Main SPD becomes unserviceable to continue the availability of the LED Light System, output unit (2) connecting the controlled DC output power to the LED Lamps through 6(*a*)& 6(*b*) and optionally connection as in feature (7) for Light Output change, DIP/DIM operation. Feature (3) shows by way of an example DIP/DIM and main, Power ON/OFF selector switch, cable and other components for a locomotive or any LED lighting application, using twin LED Lamps by way of an example. Feature (4) shows as LED Lamp having its thermal enclosure and transparent cover and connected to the power source (1) via output unit (2), may have a single LED array forming the LED cluster and fed through output unit via 6*a* and 6*b*. It is desirable to have independent controlled drive to each array from the output unit, thus where LED cluster is formed by more than one array it is desirable to have two separate controlled outputs for each array from the output unit for redundancy and reliability.

Figure 3B:
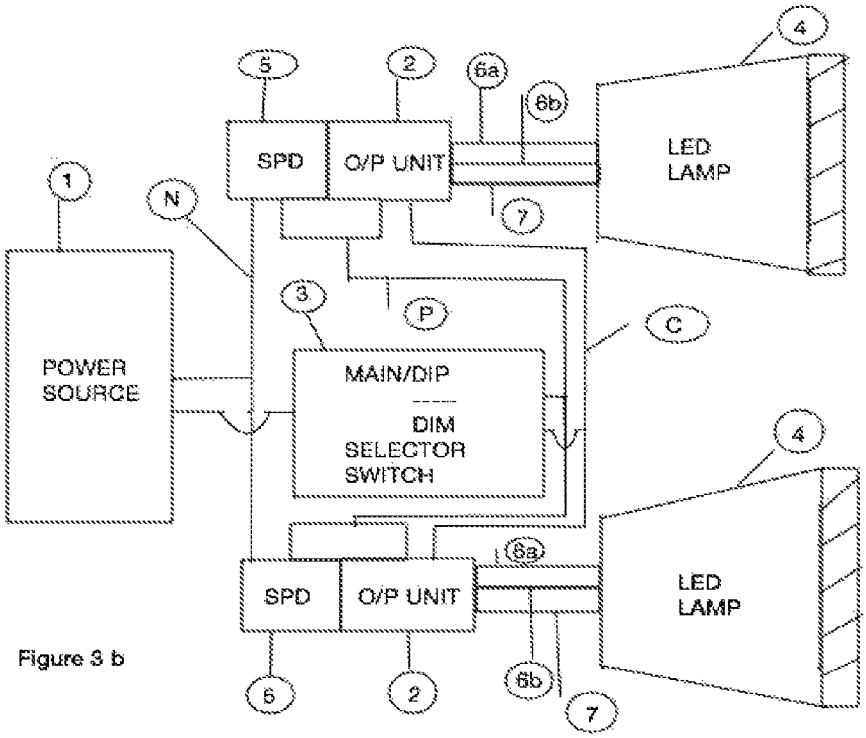

The head light at FIG. 3*b*) shows at feature 3 which is a selector switch which facilitates selection of main beam or DIP/DIM beam through the output unit which not only regulates the varying voltage coming from the power source but upon the control line selected by the selector switch through which the power source itself may be fed. The output unit will operate the LED lamp through 6*a* and 6*b* when main beam is selected, when DIP/DIM beam is selected the output unit may reduce the current of the main beam itself in which case connection 7 may not be used/present. Alternatively, 6*a*, 6*b* may operate the lamp unit in conjunction with 7 to reduce the illumination and/or dip the illumination, where 7 may be a single or a double conductor per LED array/cluster, to cause switching ON or OFF of part of an array, increase reduce current of an array, or conduct any change to cause Dipping or Dimming of the Light output of the LED Lamp.

Figure 4:
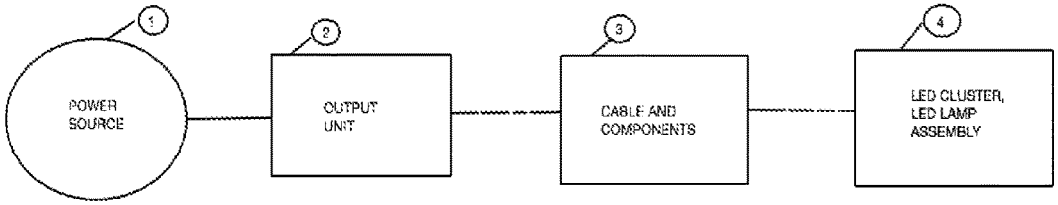
FIGS. 4 (*a*) to (*f*) show some examples of the interconnections of power source, output unit, LED cluster, and SPD.
Figure 4:
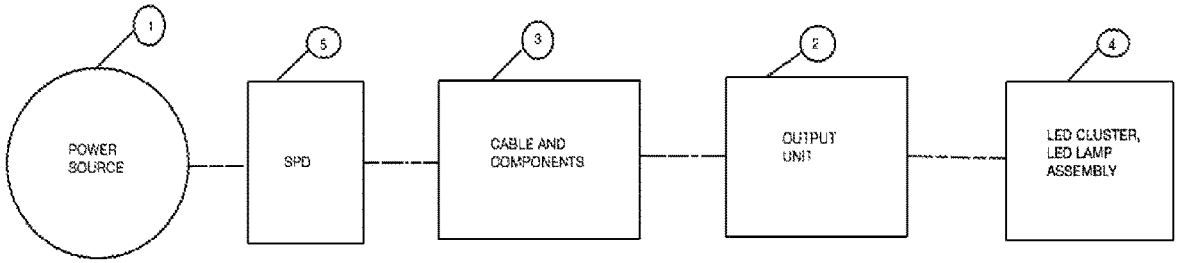
Figure 4:
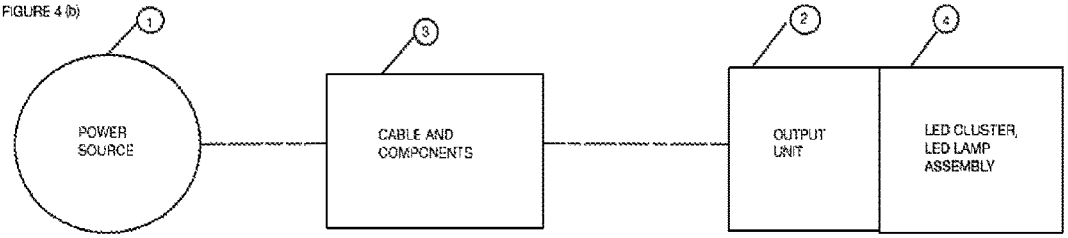
Figure 4:
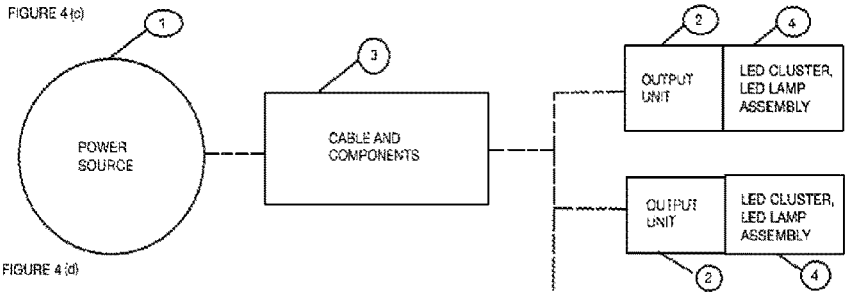
Figure 4:
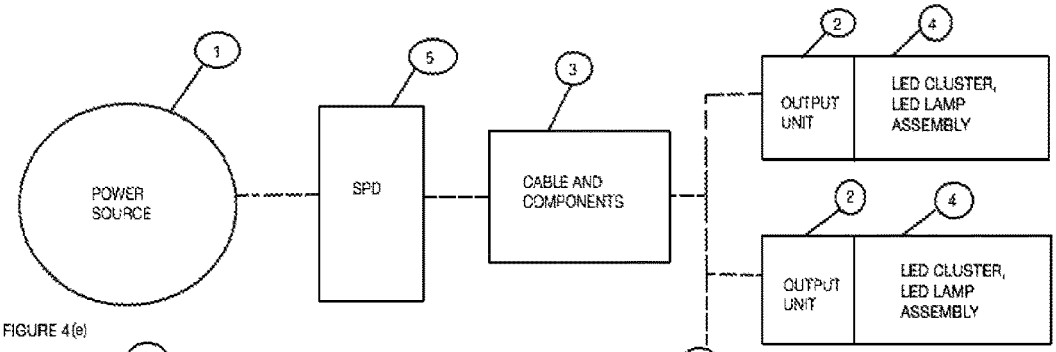
Figure 4:
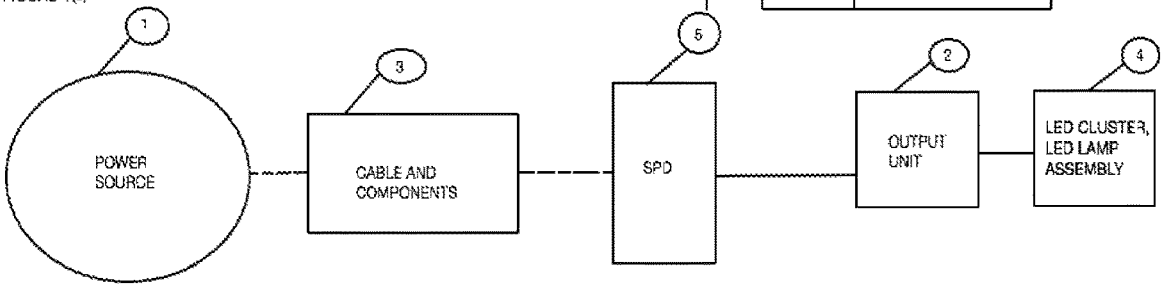

In FIG. 4 (*a, b, c, d, e, f*) the power source (1) may be AC or DC and having its variation range and with possibilities of fluctuation, output Unit (2) which may be connected away from the LED Cluster (LED Lamp, assembly as per the invention) (4) through cable and components (Switches/junctions etc.) (3), the Output unit can be nearer to the LED Lamp, integrated with the LED Lamp, in-built with the LED Lamp (LED Cluster), One output Unit may feed more than one LED Lamp and the Surge Protection Device (SPD) (5) can be connected away from LED Lamp/s at a convenient location for easy replacement, or near to the LED lamps.

Figure 5:
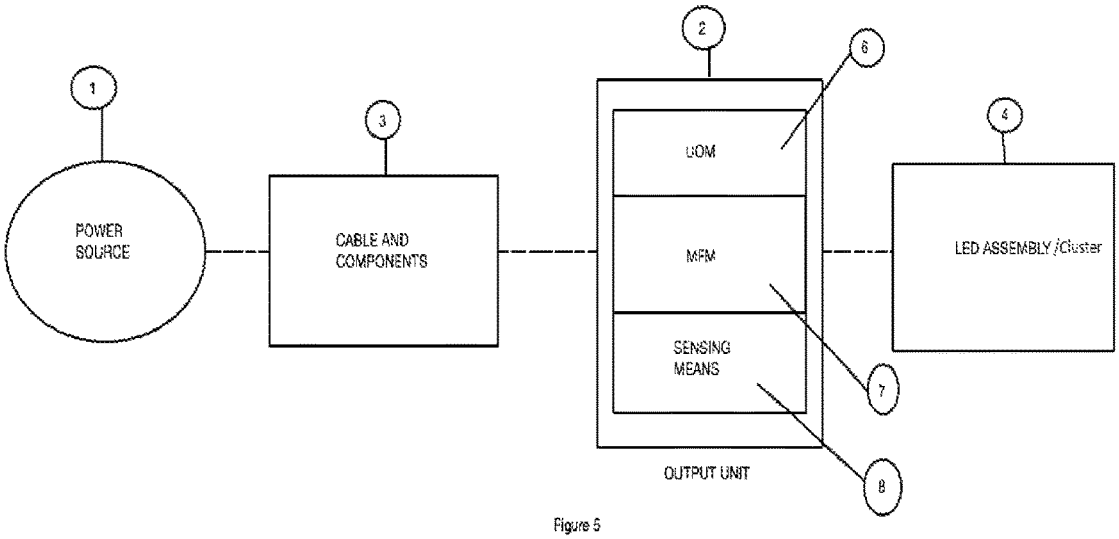
FIG. 5 shows the output unit (2) and its important sub units.

FIG. 5 shows the output unit (2) which in accordance to the invention shall have under over control means (6), multi-feedback means (7) and sensing means (8). LEDs are optionally provided in the LED cluster (4) which by virtue of their construction either can mostly fail as a short, for example, where p-n junction is directly bonded to the electrical contact instead of wire bond and/or the LED is internally provided with a electrostatic or such protection discharge device such as Zener across the LED p-n junction which generally acts as a shunt and would generally fail as a short.

Figure 6:
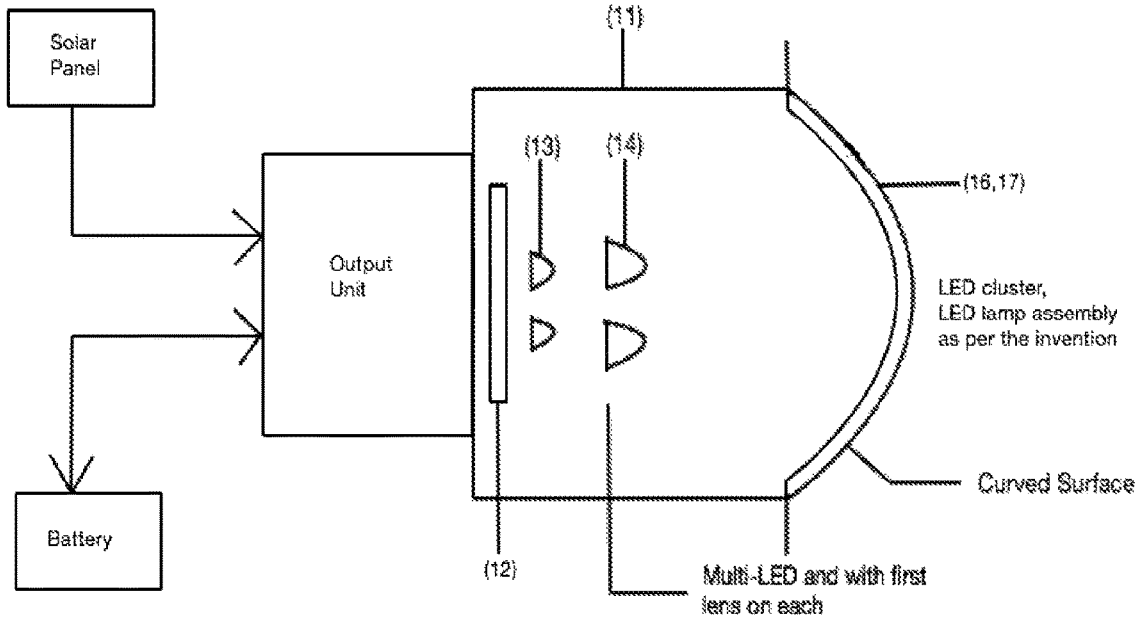
FIG. 6 shows LED Cluster, LED Lamp assembly with Output Unit connected to the LED Cluster to Drive it, LED Solar Panel and Rechargeable Battery to perform Charge Controller function & Battery power discharge controller with necessary protections of overcharging, deep discharging.

FIG. 6 shows LED Cluster, LED Lamp assembly with Output Unit connected to the LED Cluster to Drive it, LED Solar Panel and Rechargeable Battery to perform Charge Controller function & Battery power discharge controller with necessary protections of overcharging, deep discharging.

One of the main embodiment of the present invention comprises a LED light system for locomotives and alike narrow beam, multi-beam angle applications comprising:

- a LED Lamp having at least one LED cluster (4), mounted on a thermally conductive enclosure (11) with substantially transparent cover (17),
- at least one conventional LED inclusive of its in-built optics in the LED Lamp having at least one external lens (14),
- at least one LED having a twin external lens (16) to further collimate the light for narrow angle beam for distant illumination, spatial distribution control and
- a power source (1) connected to said LED Lamp through an output unit (2)

wherein, the output unit (2) comprises at least one under and over control means (UOM)(6) and at least one sensing means (8) and a multi-feedback means (MFM) (7) connected to said under and over control means (6) operating on the feedback from said at least one sensing means (8), the state of the under and over control means (6) depending upon the input received from said at least one sensing means (8) and the LED's and/or optics of a cluster are placed on a surface in close proximity for generating higher luminous stearance and the said LEDs of the cluster have a thermal control means attached to each LED and the said thermal control means is formed by a thermally conductive enclosure wherein the lens in the twin lens placed close to the LED Light source is such that it acts as a light collector for most of the exited light from the conventional LED cum collimator which acts as a virtual low loss reflector and collimates most of the light onto the second lens mounted such that the desired directional beam is generated.

Yet another embodiment of the present invention comprises of a LED light system for locomotives and alike narrow beam, multi-beam angle applications wherein at least one LED, the said LED having at least one LED chip or multichip LED being a chip on board.

Still another embodiment of the present invention comprises of a LED light system for locomotives and alike narrow beam, multi-beam angle applications wherein the transparent cover (16, 17) itself is the second lens.

Still yet another embodiment of the present invention comprises of a LED light system for locomotives and alike narrow beam, multi-beam angle applications wherein, the twin lens comprises intervening space formed into an enclosure to increase the optical efficiency of the beam intensity by further directing the light not falling on to the lens due to any reason including Fresnel effect, the said enclosure having a suitable reflecting surface.

Yet another embodiment of the present invention comprises of a LED light system for locomotives and alike narrow beam, multi-beam angle applications wherein the twin lens is optionally mounted to generate the desired narrow angle beam through its dual mechanism by varying the mounting position of the dual mechanism with respect to LED, individually or either independently or jointly to generate an efficient collimated beam.

Yet another embodiment of the present invention comprises of a LED light system for locomotives and alike narrow beam, multi-beam angle applications wherein, the beam angle of the LED source and the size of the first lens are optionally selected, to have all the LED light fall on the first lens surface.

Still yet another embodiment of the present invention comprises of a LED light system for locomotives and alike narrow beam, multi-beam angle applications wherein, optionally the inner lens is smaller and outer lens is bigger so that the outer lens can have reduced thickness, higher focal length and yet to collect the entire light exiting the first lens.

Yet another embodiment of the present invention comprises of a LED light system for locomotives and alike narrow beam, multi-beam angle applications wherein, the collimation of the light is optionally asymmetrical, i.e. narrower on one axis and wider on the other axis to give longitudinal or horizontal or wider illumination along any required axis.

Still another embodiment of the present invention comprises of a LED light system for locomotives and alike narrow beam, multi-beam angle applications wherein, the asymmetrical pattern is optionally achieved through a single external lens.

Another embodiment of the present invention comprises of a LED light system for locomotives and alike narrow beam, multi-beam angle applications wherein, the asymmetrical pattern is optionally achieved through a twin external lens.

Still another embodiment of the present invention comprises of a LED light system for locomotives and alike narrow beam, multi-beam angle applications wherein, the lens and LED assemblies are optionally placed in close proximity to form a combined mono axis or multi axis beam, symmetrical and/or asymmetrical.

Yet another embodiment of the present invention comprises of a LED light system for locomotives and alike narrow beam, multi-beam angle applications wherein, the single external lens is mounted with its optical axis with respect to the optical axis of the LED at an angle for one or more LED's in the LED cluster (4) of the lamp, to tilt its beam with respect to the optical axis of the LED lamp.

Still yet another embodiment of the present invention comprises of a LED light system for locomotives and alike narrow beam, multi-beam angle applications wherein, the said output unit (2) is optionally integrated within the lamp unit.

Yet another embodiment of the present invention comprises of a LED light system for locomotives and alike narrow beam, multi-beam angle applications wherein, at least one surge protection device (SPD) (5) is optionally integrated or separate with the output unit (2). Still yet another embodiment of the present invention comprises of a LED light system for locomotives and alike narrow beam, multi-beam angle applications wherein, the said surge protection device (5) is optionally a spare unit separate or integrated as a switchable standby SPD unit.

Yet another embodiment of the present invention comprises of a LED light system for locomotives and alike narrow beam, multi-beam angle applications wherein, the surge protection device (SPD) (5) shall be optionally provided with at least one spike arrestor/MOV and a fuse.

Still another embodiment of the present invention comprises of a LED light system for locomotives and alike narrow beam, multi-beam angle applications wherein, SPD (5) shall be optionally provided with spike arrestor/MOV and a Gas Discharge tube, in which case fuse may or may not be provided.

Further yet another embodiment of the present invention comprises of a LED light system for locomotives and alike narrow beam, multi-beam angle applications wherein, the SPD is optionally self-restoring wherein it shall cut off when the surge/overvoltage is greater than duration T1.

Yet still another embodiment of the present invention comprises of a LED light system for locomotives and alike narrow beam, multi-beam angle applications wherein, the said SPD is optionally self-restoring with cut off lower than the operating voltage of the MOV in the SPD wherein spike arrestor/MOV shall absorb the surges up to duration (T1).

Another embodiment of the present invention comprises of a LED light system for locomotives and alike narrow beam, multi-beam angle applications wherein, when external surge protection device [ESPD] is provided, the output unit (2) may be optionally provided with internal spike control/MOV which then is of higher voltage than that in SPD so that MOV in the SPD would fail being operative at a lower voltage in the event cut off is not provided or provided and does not operate protecting the MOV in the output unit (2) and thereby the output unit (2), LED Light would be prevented from replacement & SPD placed at a convenient location can be easily replaced thereby reducing the cost of spares and maintenance.

Still another embodiment of the present invention comprises of a LED light system for locomotives and alike narrow beam, multi-beam angle applications wherein, when the combination of SPD & MOV is inside the output unit (2), MOV of the output unit (2) shall optionally have the higher operating voltage than the MOV inside the SPD followed by the self-restoring cut-off which shall be lowest in operating voltage and as long as the cut-off operates the entire system operation shall be self-restoring when voltage surge diminishes and operating voltage is within the specified limits of normal operation.

Yet another embodiment of the present invention comprises of a LED light system for locomotives and alike narrow beam, multi-beam angle applications wherein, the high voltage and/or low voltage cut off is provided.

Still yet another embodiment of the present invention comprises of a LED light system for locomotives and alike narrow beam, multi-beam angle applications wherein, if the high voltage cut off is the lowest operating voltage then optionally the high voltage cut-off may not be provided in the SPD.

Yet still another embodiment of the present invention comprises of a LED light system for locomotives and alike narrow beam, multi-beam angle applications wherein, at least one output unit (2) is optionally a spare unit.

Yet another embodiment of the present invention comprises of a LED light system for locomotives and alike narrow beam, multi-beam angle applications wherein, the said LED lamp has at least one LED having a twin lens to direct the light.

Still another embodiment of the present invention comprises of a LED light system for locomotives and alike narrow beam, multi-beam angle applications wherein, dimming facility is provided optionally for reducing the average current flowing through LEDs with power saving.

Yet another embodiment of the present invention comprises of a LED light system for locomotives and alike narrow beam, multi-beam angle applications wherein, a switch control is optionally provided to produce a dip and/or dim means for reducing and/or changing the direction of the light or leaving lit only the changed beam direction of LED light sources.

Still yet another embodiment of the present invention comprises of a LED light system for locomotives and alike narrow beam, multi-beam angle applications wherein, a means is optionally provided for shifting the illumination axis of the light by changing the mounting angle of the lens with respect to the LED i.e. the mounting axis of the lens with respect to the mounting axis of the LED or the mounting axis of the LED itself along with its lens by changing the mounting axis of the surface for the LED in the enclosure.

Still yet another embodiment of the present invention comprises of a LED light system for locomotives and alike narrow beam, multi-beam angle applications wherein, a means is optionally provided to produce a dip and/or dim means by having the shifted illumination axis LEDs lit and others on the main illumination axis unlit.

Yet another embodiment of the present invention comprises of a LED light system for locomotives and alike narrow beam, multi-beam angle applications wherein, an external control interface is provided to activate the DIP/DIM or main or combined beams.

Still yet another embodiment of the present invention comprises of a LED light system for locomotives and alike narrow beam, multi-beam angle applications wherein, each beam is optionally defined as the beam formed by using at least one LED or a cluster of LEDs wherein even with cluster of LEDs each LED lamp unit may have multi-directional beams.

Yet another embodiment of the present invention comprises of a LED light system for locomotives and alike narrow beam, multi-beam angle applications wherein the LED light system, wherein the dimming facility optionally uses the external SPD that may be installed before the dimming selection switch where the Dimming line & the Main (full light) line are separated but carry the same power supply.

Yet another embodiment of the present invention comprises of a LED light system for locomotives and alike narrow beam, multi-beam angle applications wherein, the light/lamp is optionally sealed with at least one cover preferably glass to prevent ingress of water and dust, wherein the transparent cover of the LED Lamp is optionally formed using a toughened glass. Yet another embodiment of the present invention comprises of a LED light system for locomotives and alike narrow beam, multi-beam angle applications wherein, the said beam lamp or lamps are optionally replaceable.

Another embodiment of the present invention comprises of a LED light system for locomotives and alike narrow beam, multi-beam angle applications wherein, the lamps cover is optionally kept small enough to have adequate impact strength and comprises optionally adequate cut-outs in a metal mounting frame to allow full light emission to avoid the need of bird guards.

Yet another embodiment of the present invention comprises of a LED light system for locomotives and alike narrow beam, multi-beam angle applications wherein, optionally one adjustment means is provided for making the beam lights exiting the LED Lamps in a multi-lamp system in the same direction coherent, or adjustment in any direction with respect to each other.

Yet another embodiment of the present invention comprises of a LED light system for locomotives and alike narrow beam, multi-beam angle applications wherein, optionally second adjustment means is provided for directing the said multi-lamp beam light with respect to the locomotive/mounting plane.

Yet another embodiment of the present invention comprises of a LED light system for locomotives and alike narrow beam, multi-beam angle applications wherein, each beam is optionally defined as the beam formed by using at least one LED lamp unit and multi-beam is formed by more than one such LED Lamp unit.

Still yet another embodiment of the present invention comprises of a LED light system for locomotives and alike narrow beam, multi-beam angle applications wherein, the output unit (2) facilitates energy efficient conversion, through a driver circuit allowing the Power source (1) and its variations to be matched to the controlled drive required for the LEDs with input and/or output control using under over control means, as per the requirement of different voltage and/or current of the series and parallel combination of the LED array cluster.

Yet still another embodiment of the present invention comprises of a LED light system for locomotives and alike narrow beam, multi-beam angle applications wherein, the sensing means (8) is selected from a current sensing means, voltage sensing means, temperature sensing means, optical sensing means or any combination thereof.

Further yet another embodiment of the present invention comprises of a LED light system for locomotives and alike narrow beam, multi-beam angle applications wherein, the thermally conductive enclosure is provided with heat sink fins for faster extraction of heat, since due to space limitations the thermally conductive enclosure surface becomes inadequate for thermal management.

Yet another embodiment of the present invention comprises of a LED light system for locomotives and alike narrow beam, multi-beam angle applications wherein, the said LED's of a cluster are optionally placed on a substantially flat single or multisided surface.

Still another embodiment of the present invention comprises of a LED light system for locomotives and alike narrow beam, multi-beam angle applications wherein, the twin lens comprises of an enclosure having an external as well as internal reflecting surface.

Yet still another embodiment of the present invention comprises of a LED light system for locomotives and alike narrow beam, multi-beam angle applications wherein, the said system optionally has an active or a passive shunt across a series of said LED cluster (4) to reduce the current flow through LED's to reduce the illumination/dimming of light.

Yet another embodiment of the present invention comprises of a LED light system for locomotives and alike narrow beam, multi-beam angle applications wherein, active or passive shunt is optionally provided across each LED in series in the LED cluster (4) to prevent failure in the event of open circuit failure of the LED.

Further, yet another embodiment of the present invention comprises of a LED light system for locomotives and alike narrow beam, multi-beam angle applications wherein, the said LEDs are optionally provided in the LED cluster (4).

Still yet another embodiment of the present invention comprises of a LED light system for locomotives and alike narrow beam, multi-beam angle applications wherein, the said LED light device is as headlights for locomotives, stadium and other narrow beam applications.

Although, the present invention has been described with reference to features, it will be apparent to those skilled in the art that this description is only a preferred embodiment and does not limit the scope of the present invention. Variations and modifications are possible without departing from the scope and spirit of the invention disclosed/described herein and are intended to be encompassed therein.

We claim:

1. An LED light system for locomotives and alike narrow beam, multi-beam angle applications comprising:

an LED lamp having at least one LED cluster mounted on a thermally conductive enclosure with substantially transparent cover, the at least one LED cluster including multiple LEDs placed on a surface in close proximity for generating higher luminous stearance and attached to the thermally conductive enclosure, at least one LED of the multiple LEDs having at least one single external lens and at least one LED of the multiple LEDs having at least one two lens arrangement for collimating the light from the at least one LED for generating a desired directional beam for distant illumination and spatial distribution control; and a power source connected to said LED Lamp through an output unit, wherein:

the output unit includes at least one under and over control means (UOM), at least one sensing means, and a multi-feedback means (MFM) connected to said at least one under and over control means operating on the feedback from said at least one sensing means, the state of the at least one under and over control means depending upon the input received from said at least one sensing means; and a first lens of a two lens arrangement is positioned close to at least one LED and acts as a light collector for collecting most of light exited from the at least one LED and direct the collected light onto a second lens of the two lens arrangement mounted for collimating the collected light and generating the desired directional beam.

2. The LED light system as claimed in claim 1, wherein the at least one LED is a single chip LED or a multichip LED being a chip on board.

3. The LED light system as claimed in claim 1, wherein for the two lens arrangement, an intervening space forms an enclosure from the at least one LED up to the second lens to increase optical efficiency of light by further directing the light not falling onto the first or second lenses due to any reason including Fresnel effect, said enclosure having a suitable reflecting surface, and wherein the two lens arrangement is mounted to generate the desired directional beam through its dual mechanism by varying a mounting position of the dual mechanism with respect to the at least one LED, individually or either independently or jointly.

4. The LED light system as claimed in claim 1, wherein the collimation of the collected light is asymmetrical such that the light is narrower on one axis and wider on the other axis to give longitudinal or horizontal or wider illumination along any required axis, and wherein the asymmetrical collimation is achieved through at least one of the single external lens or the two lens arrangement.

5. The LED light system as claimed in claim 1, wherein the at least one single external lens is mounted at an angle with respect to an optical axis of the at least one LED to tilt light beam exited from the at least one LED.

6. The LED light system as claimed in claim 1, wherein said output unit is integrated within the LED light system.

7. The LED light system as claimed in claim 1, further comprising a surge protection device (SPD).

8. The LED light system as claimed in claim 7, wherein when an external surge protection device [ESPD] is provided, the output unit is provided with an internal spike control/MOV having a higher voltage than that in the SPD so that the MOV in the SPD would fail being operative at a lower voltage in an event cut off is not provided or provided and does not operate protecting the MOV in the output unit and thereby the output unit, the at least one LED would be prevented from replacement and the SPD placed at a convenient location is easily replaced thereby reducing cost of spares and maintenance.

9. The LED light system as claimed in claim 7, wherein when the combination of the SPD and the MOV is inside the output unit, the MOV of the output unit has a higher operating voltage than the MOV inside the SPD followed by a self-restoring cut-off which shall be lowest in operating voltage and as long as the cut-off operates the entire system operation shall be self-restoring when voltage surge diminishes and operating voltage is within a specified limits of normal operation.

10. The LED light system as claimed in claim 1, wherein a dimming facility is provided for reducing an average current flowing through at least one LED with power saving.

11. The LED light system as claimed in claim 1, wherein a means is provided for shifting an illumination axis of light exited from the at least one LED by changing a mounting angle of the at least one single external lens or the two lens arrangement with respect to the at least one LED, and wherein a dip and/or dim means is optionally provided to produce a dip and/or dim beam by having shifted illumination axis LEDs lit and others LEDs on unshifted illumination axis unlit.

12. The LED light system as claimed in claim 1, wherein the LED light system is a multi-lamp system having multiple LED lamps, the light system further comprising:

an adjustment means for directing light beams exiting the LED lamps in same coherent direction, or different directions with respect to each other; and a second adjustment means for directing light beams exiting the multi-lamp system with respect to a locomotive/mounting plane.

13. The LED light system as claimed in claim 1, wherein the output unit facilitates energy efficient conversion, through a driver circuit allowing the power source and its variations to be matched to a controlled drive required for the at least one LED with input and/or output control using the at least one under over control means, as per the requirement of different voltage and/or current of the series and parallel combination of the at least one LED cluster.

14. The LED light system as claimed in claim 1, wherein the sensing means is at least one of a current sensing means, a voltage sensing means, a temperature sensing means, an optical sensing means or any combination thereof.

15. The LED light system as claimed in claim 1, wherein the thermally conductive enclosure is provided with heat sink fins for faster extraction of heat, since due to space limitations the thermally conductive enclosure surface becomes inadequate for thermal management.

16. The LED light system as claimed in claim 1, wherein the two lens arrangement includes an enclosure having an external as well as an internal reflecting surface.

17. The LED light system as claimed in claim 1, wherein the LED light system has an active or a passive shunt that is at least:

across a series of at least one LED cluster to reduce the current flow through the at least one LED to reduce the illumination/dimming of light, and across each LED in series in the at least one LED cluster to prevent failure in the event of open circuit of each of the LED.

18. The LED light system as claimed in claim 1, wherein the output unit is connected to the LED lamp system via a solar panel and a rechargeable battery to perform charge controller function and battery power discharge controller with necessary protections of overcharging, deep discharging.

* * * * *